US007027017B2

(12) United States Patent
Yer

(10) Patent No.: US 7,027,017 B2
(45) Date of Patent: Apr. 11, 2006

(54) POWER SUPPLY FOR LIQUID CRYSTAL DISPLAY PANEL

(75) Inventor: Jung-Taeck Yer, Kyoungsangbuk-Do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 465 days.

(21) Appl. No.: 10/325,847

(22) Filed: Dec. 23, 2002

(65) Prior Publication Data

US 2003/0122814 A1 Jul. 3, 2003

(30) Foreign Application Priority Data

Dec. 31, 2001 (KR) ..... 2001-89290

(51) Int. Cl.
*G09G 3/36* (2006.01)

(52) U.S. Cl. ..... 345/87; 345/211; 345/204

(58) Field of Classification Search ..... 345/87–104, 345/204–206

See application file for complete search history.

(56) References Cited

U.S. PATENT DOCUMENTS

| | | | | |
|---|---|---|---|---|
| 5,323,171 | A * | 6/1994 | Yokouchi et al. | 345/94 |
| 5,402,142 | A * | 3/1995 | Okada et al. | 345/95 |
| 5,663,743 | A * | 9/1997 | Fujii et al. | 345/95 |
| 6,677,923 | B1 * | 1/2004 | Kajihara et al. | 345/89 |
| 6,844,839 | B1 * | 1/2005 | Lee et al. | 341/144 |

* cited by examiner

*Primary Examiner*—Xiao Wu
(74) *Attorney, Agent, or Firm*—Morgan, Lewis & Bockius LLP

(57) ABSTRACT

A power supply for a liquid crystal display panel, comprising a booster generating unit for generating a power voltage by boosting a system voltage comprising at least one operational amplifier for generating a common voltage and a gamma reference voltage, the booster further comprising at least one capacitor, at least one inductor, and at least one resistance arranged outside an integrated circuit, a common voltage generating unit having at least one operational amplifier, at least one resistance and at least one capacitor, wherein the at least one operational amplifier is located within the integrated circuit, and a gamma voltage generating unit having at least one operational amplifier and a resistance network wherein the resistance network is located outside the integrated circuit.

14 Claims, 9 Drawing Sheets

POWER SUPPLY FOR LIQUID CRYSTAL DISPLAY PANEL

The present invention claims the benefit of Korean Patent Application No. 89290/2001 filed in Korea on Dec. 31, 2001, which is hereby incorporated by reference.

BACKGROUND OF THE INVENTION

1. Field of the Invention

The present invention relates to a liquid crystal display panel, and more particularly, to a power supply for a liquid crystal display panel supplying a common voltage and a gamma reference voltage by using one integrated circuit (IC) chip and having a gate on/off voltage generating unit.

2. Description of the Related Art

In general, a liquid crystal display panel displays a picture on a screen by adjusting light transmittance of a liquid crystal according to picture information. The liquid crystal display panel includes liquid crystal cells arranged in a matrix form and a switching device such as a TFT (thin film transistor) corresponding to the liquid crystal cells to switch picture information supplied to each liquid crystal cell.

A driving unit of the liquid crystal display panel controls the switching device to supply the picture information to the corresponding liquid crystal cells. In addition, the driving unit of the liquid crystal display panel controls picture information so as to have positive and negative electricity within a specific voltage level in order to restrain picture deterioration such as flickering or an afterimage, and lower a driving voltage.

In general the liquid crystal display panel has gamma characteristics wherein gradation of a picture is varied nonlinearly according to a voltage level of picture information. The gamma characteristics are caused by light transmittance of liquid crystal. Light transmittance of the liquid crystal is not linearly varied according to a voltage level of picture information, and gradation of a picture is not linearly varied according to light transmittance of the liquid crystal. Accordingly, in order to vary the gradation of the picture according to a voltage level of picture information, by applying a preset gamma voltage to the voltage level of the picture information as an offset voltage, the gamma characteristics can be compensated and deterioration of the picture can be prevented.

In order to generate a driving voltage for controlling the switching device, a common voltage having a specific voltage level and a gamma voltage for compensating the gamma characteristics, voltage generating circuits are disposed in the liquid crystal display panel, and are described with reference to the accompanying drawings.

FIG. 1 is a schematic view of a block construction of a liquid crystal display panel and a driving unit thereof according to the related art. In FIG. 1, a liquid crystal display apparatus includes a liquid display panel 10 having a picture display unit 13, a gate driving unit 20, and a data driving unit 30, a timing controller 40 for controlling a driving timing of the gate driving unit 20 and the data driving unit 30, and a power unit 50 for supplying a voltage to the liquid crystal display panel 10, the gate driving unit 20, the data driving unit 30, and the timing controller 40 by receiving a 3.3V system voltage ($V_{SYS}$).

In the picture display unit 13 of the liquid crystal display panel 10, liquid crystal cells are arranged on a region at which gate wiring placed in the horizontal direction at regular intervals and data wiring placed in the vertical direction at regular intervals cross each other. In addition, the gate driving unit 20 of the liquid crystal display panel 10 drives the liquid crystal cells arranged in a matrix form by the gate wiring units by sequentially applying scanning signals to the gate wiring, and the data driving unit 30 applies picture information to the liquid crystal cells operated according to the scanning signals received through the data wiring.

The timing controller 40 supplies a control signal (CS) to the gate driving unit 20 and supplies the control signal (CS) and picture information (DATA [R,G,B]) to the data driving unit 30. The timing controller 40 controls a timing operation of the gate driving unit 20 and the data driving unit 30 by supplying a certain clock signal, a gate start signal, and a timing signal as the control signal (CS).

The power unit 50 includes a gate driving voltage generating unit 51 for supplying gate on/off voltages ($V_{G\text{-}ON}$, $V_{G\text{-}OFF}$) to the gate driving unit 20; a common voltage generating unit 52 for supplying a common voltage (Vcom) to a common electrode (not shown) of the picture display unit 13; and a gamma voltage generating unit 53 supplying a gamma voltage ($V_{GMA}$) for compensating the gamma characteristics to the data driving unit 30.

FIG. 2 is a circuit diagram of a gate driving voltage generating unit of FIG. 1. In FIG. 2, the gate driving voltage generating unit 51 includes a booster 61 for generating a reference voltage ($V_{REF}$) of 7V by boosting the 3.3V system voltage ($V_{SYS}$), and a first and a second pumping units 62, 63 for generating the gate on/off voltages ($V_{G\text{-}ON}$, $V_{G\text{-}OFF}$) by pumping and clamping the reference voltage ($V_{REF}$) of the booster 61. The booster 61 includes an 11th node (N11) in which the 3.3V system voltage ($V_{SYS}$) is applied and an 11th capacitor (C11) contacted to an earth potential (VSS) therebetween, a 12th node (N12) in which the earth potential (VSS) is periodically applied by the switching device (SW) and an 11th inductor (L11) contacted to the 11th node (N11) therebetween, a 13th node (N13) in which a forward 11th diode (D11) is contacted to the 12th node (N12) therebetween, a 12th capacitor (C12) contacted to the earth potential (VSS) therebetween, an 11th and a 12th resistance (R11, R12) contacted to the earth potential (VSS) therebetween in order to boost the 3.3V system voltage ($V_{SYS}$) to the 7V reference voltage ($V_{REF}$) and outputting it.

The first pumping unit 62 includes a 21st node (N21) in which a 21st capacitor (C21) is contacted to the 12th node (N12) therebetween, and a forward 21st diode (D21) is contacted to the 13th node (N13) of the booster 61 therebetween, a 22nd node (N22) in which a 22nd capacitor (C22) is contacted to the 13th node (N13) of the booster 61 therebetween, and a forward 22nd diode (D22) is contacted to the 21st node (N21) therebetween, a 23rd node (N23) in which a 23rd capacitor (C23) is contacted to the 12th node (N12) of the booster 61 therebetween, and a forward 23rd diode (D23) is contacted to the 22nd node (N22) therebetween, and a 24th node (N24) in which a forward 24th diode (D24) is contacted to the 23rd node (N23) therebetween, and a 24th capacitor (C24) is contacted to the earth potential (VSS) therebetween to output a 21V gate ON voltage ($V_{G\text{-}ON}$) by pumping and clamping the 7V reference voltage ($V_{REF}$).

The second pumping unit 63 includes a 31st node (N31) in which a 31st capacitor (C31) contacted to the 12th node (N12) of the booster 61 therebetween and a backward 31st diode (D31) contacted to the earth potential (VSS) therebetween; and a 32nd node (N32) in which a backward 32nd diode (D32) is contacted to the 31st node (N31) therebetween and a 32nd capacitor (C32) contacted to the earth potential (VSS) therebetween to output a −7V gate OFF voltage ($V_{G\text{-}OFF}$) by pumping and clamping the 7V reference voltage ($V_{REF}$).

FIG. 3 is a circuit diagram of a circuit construction of a common voltage generating unit of FIG. 1. In FIG. 3, the common voltage generating unit 52 includes a 41st and a 42nd resistance (R41, R42) for dividing a power voltage (VDD), a variable resistance (VR41) and a 41st capacitor (C41) contacted between the 41st and 42nd resistance (R41, R42) and adjusting a level of the divided power voltage (VDD), and a 41st operational amplifier (OP-AMP41) receiving the power Voltage (VDD) divided by the 41st and 42nd resistance (R41, R42) and level-adjusted by the variable resistance (VR41) and the 41st capacitor (C41) through a non-inversion terminal (+), receiving back an output thereof through an inversion terminal (−), adjusting a level through the 43 rd resistance (R43) and the 42nd capacitor (C42) and outputting it as the common voltage (Vcom). The 41st and 42nd resistance (R41, R42) generate a specific level common voltage (Vcom) by dividing the power voltage (VDD) and applying it to the non-inversion terminal (+) of the 41st operational amplifier (OP-AMP41). In order to vary the level of the common voltage (Vcom), a resistance value of the variable resistance (VR41) is varied.

FIG. 4 is a circuit diagram of a circuit construction of a gamma voltage generating unit of FIG. 1. In FIG. 4, the gamma voltage generating unit 53 includes a high level unit 71 for generating high level gamma voltage ($V_{GMAH1}$~$V_{GMAH5}$) having an inverted electricity per 1 horizontal cycle (1 Hs) according to dot inversion driving; and a low level unit 72 for generating low level gamma voltage ($V_{GMAL1}$~$V_{GMAL5}$). The high level unit 71 divides the power voltage (VDD51) according to a resistance ratio of the serially contacted 51st~56th resistance (R51~R56) and generates the high level gamma voltage ($V_{GMAH1}$~$V_{GMAH5}$) in the 51st~55th nodes (N51~N55). The high level gamma voltage ($V_{GMAH1}$) of the 51st node (N51) has a voltage level corresponding to a black level, the high level gamma voltage ($V_{GMAH3}$) of the 53rd node (N53) has a voltage level corresponding to an intermediate level, and the high level gamma voltage ($V_{GMAH5}$) of the 55th node (N55) has a voltage level corresponding to a white level. From the high level gamma voltage ($V_{GMAH1}$) of the 51st node (N51) to the high level gamma voltage ($V_{GMAH5}$) of the 55th node (N55), the voltage level is decreased.

In addition, the low level unit 72 divides the power voltage (VDD52) according to a resistance ratio of the serially contacted 57th~62nd resistance (R57~R62) and respectively generates the low level gamma voltage ($V_{GMAL1}$~$V_{GMAL5}$) in the 56th~60th nodes (N56~N60). The low level gamma voltage ($V_{GMAL1}$) of the 56th node (N56) has a voltage level corresponding to a black level, the low level gamma voltage ($V_{GMAL3}$) of the 58th node (N58) has a voltage level corresponding to an intermediate level, and the low level gamma voltage ($V_{GMAL5}$) of the 60th node (N60) has a voltage level corresponding to a white level. From the low level gamma voltage ($V_{GMAL1}$) of the 56th node (N56) to the low level gamma voltage ($V_{GMAL5}$) of the 60th node (N60), the voltage level is increased.

The high level gamma voltage ($V_{GMAH1}$~$V_{GMAH5}$) and the low level gamma voltage ($V_{GMAL1}$~$V_{GMAL5}$) are respectively applied to the non-inversion terminal (+) of the 51st~the 60th operational amplifiers (OP-AMP51~OP-AMP60) through a bus line. The output of the 51st~the 60th operational amplifiers (OP-AMP51~OP-AMP60) is returned to the inversion terminal (−) and is outputted to the data driving unit 30 as the gamma voltage ($V_{GMA1}$~$V_{GMA10}$) through the 51st~the 60th capacitors (C51~C60) respectively disposed in the output end of the 51st~the 60th operational amplifiers (OP-AMP51~OP-AMP60).

As described above, in the power supply of the related art liquid crystal display panel, the gate on/off voltage, the common voltage and the gamma reference voltage generating circuit required for operation of the liquid crystal display panel are separately constructed. Accordingly, since three or four IC chips and additional parts are required, it is difficult to lower production costs and maintain competitive prices.

SUMMARY OF THE INVENTION

Accordingly, the present invention is directed to a power supply for a liquid crystal display panel that substantially obviates one or more of the problems due to limitations and disadvantages of the related art.

An object of the present invention is to provide a power supply of a liquid crystal display panel which is capable of supplying a common voltage and a gamma reference voltage required for operation of a liquid crystal display panel with one IC chip including a gate on/off voltage generating unit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a power supply for a liquid crystal display panel includes a switching device for generating a power voltage by boosting a system voltage, a booster disposing an operational amplifier for generating a common voltage and operational amplifiers for generating a gamma reference voltage inside and having capacitors, an inductor and resistance arranged outside except the switching device, a common voltage generating unit having resistance and capacitors arranged outside except the operational amplifier, and a gamma voltage generating unit having a resistance network arranged outside except the operational amplifiers.

In another aspect, a power supply for a liquid crystal display panel, includes a booster generating unit for generating a power voltage by boosting a system voltage including at least one operational amplifier for generating a common voltage and a gamma reference voltage, the booster further comprising at least one capacitor, at least one inductor, and at least one resistance arranged outside an integrated circuit, a common voltage generating unit having at least one operational amplifier, at least one resistance and at least one capacitor, wherein the at least one operational amplifier is located within the integrated circuit, and a gamma voltage generating unit having at least one operational amplifier and a resistance network wherein the resistance network is located outside the integrated circuit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Reference will be made in detail to the preferred embodiments of the present invention, examples of which are illustrated in the accompanying drawings.

Figure 1:
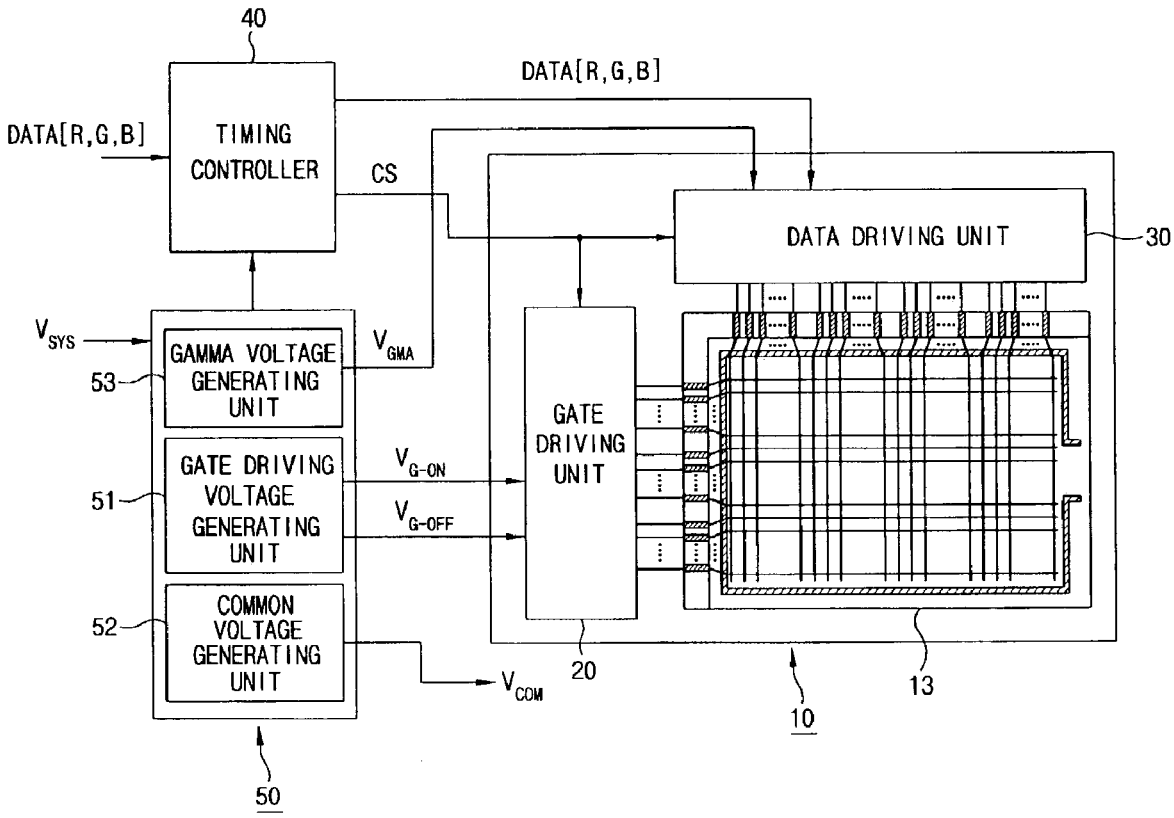
FIG.1 RELATED ART
FIG. 1 is a schematic view of a block construction of a liquid crystal display panel and a driving unit thereof according to the related art.
Figure 2:
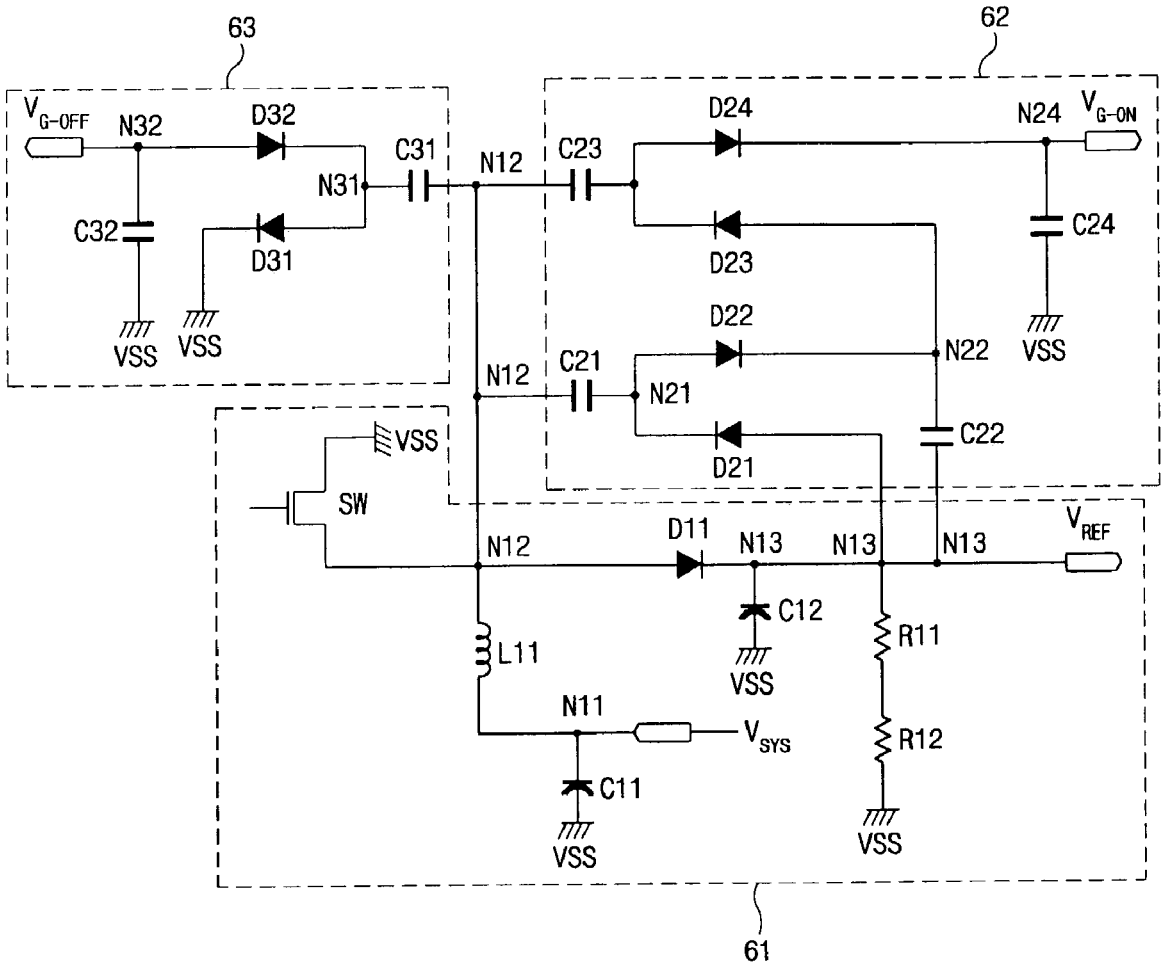
FIG.2 RELATED ART
FIG. 2 is a circuit diagram of a gate driving voltage generating unit of FIG. 1.
Figure 3:
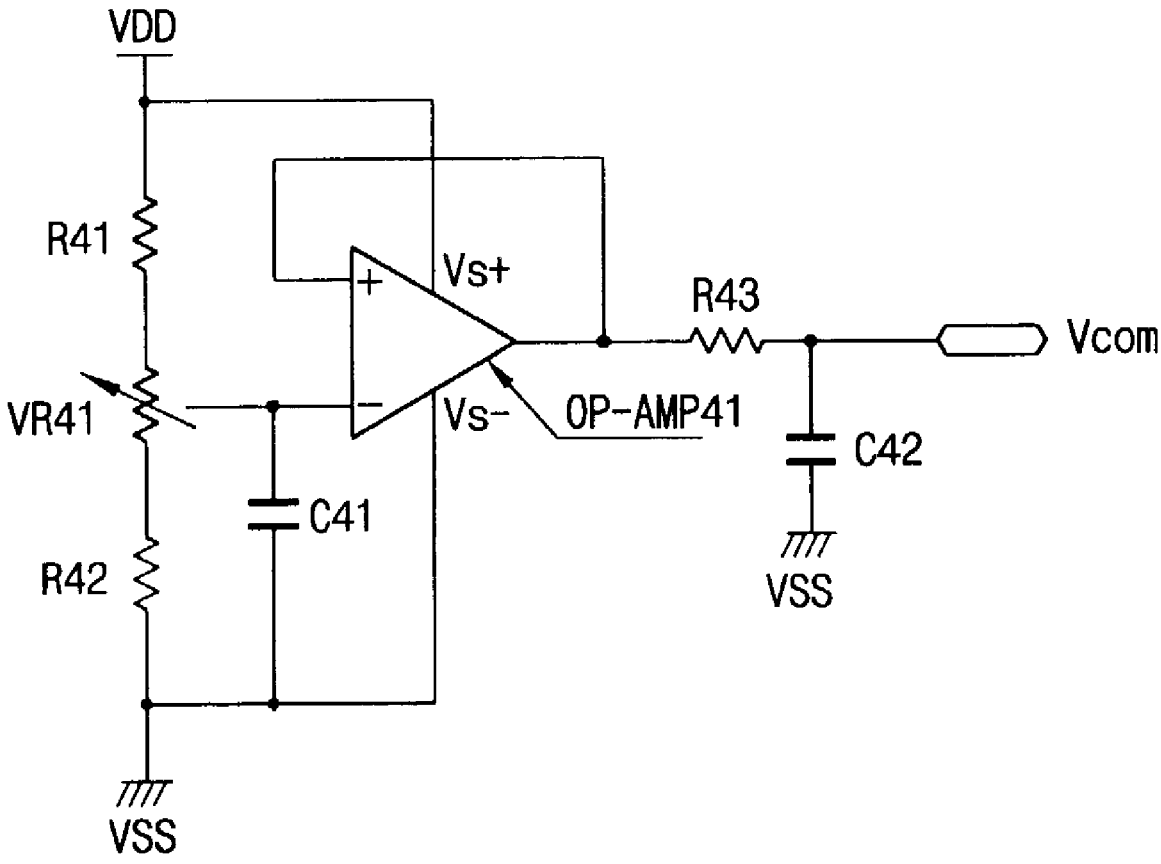
FIG. 3 RELATED ART
FIG. 3 is a circuit diagram of a common voltage generating unit of FIG. 1.
Figure 4:
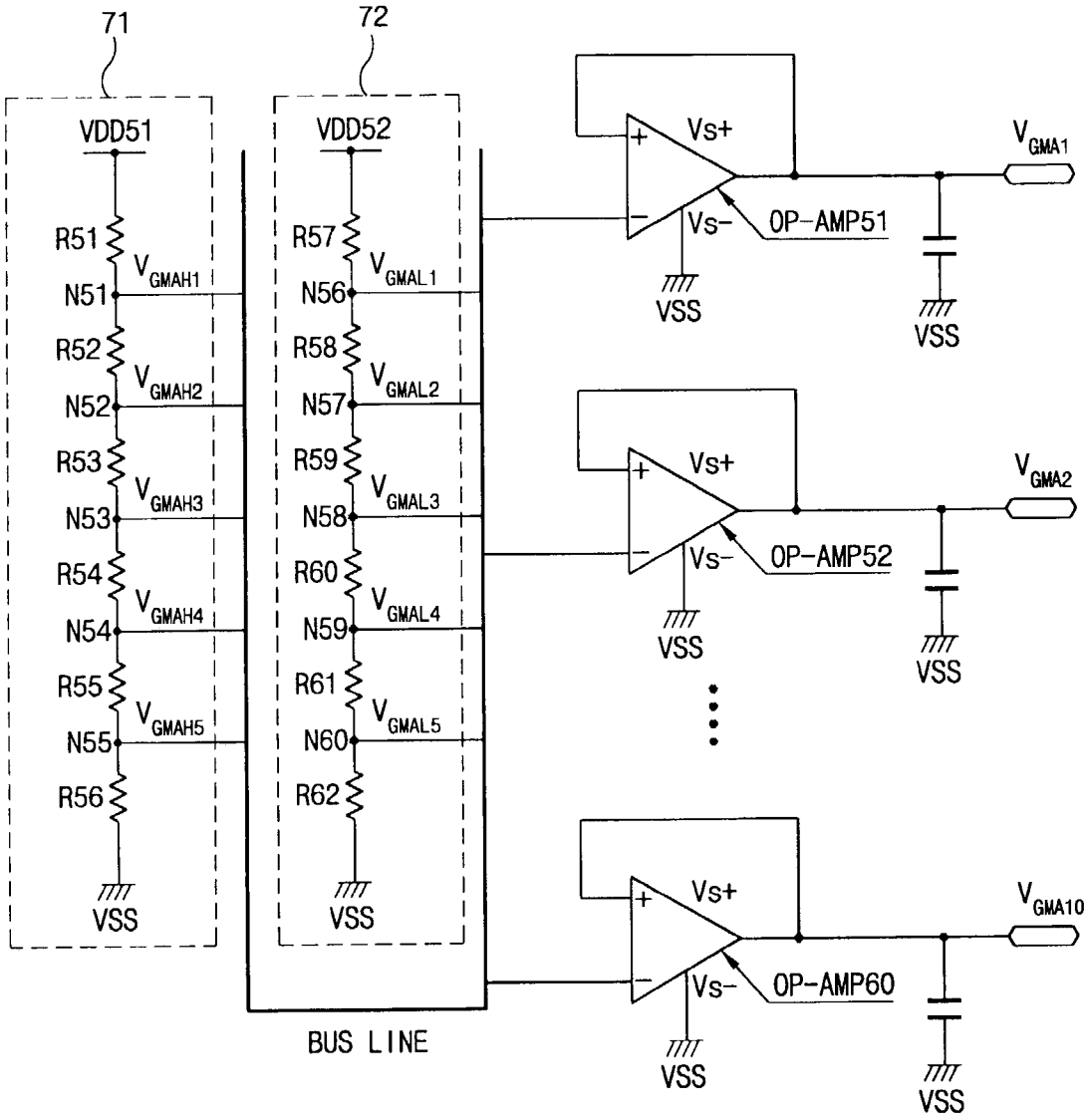
FIG.4 RELATED ART
FIG. 4 is a circuit diagram of a gamma voltage generating unit of FIG. 1.
Figure 5:
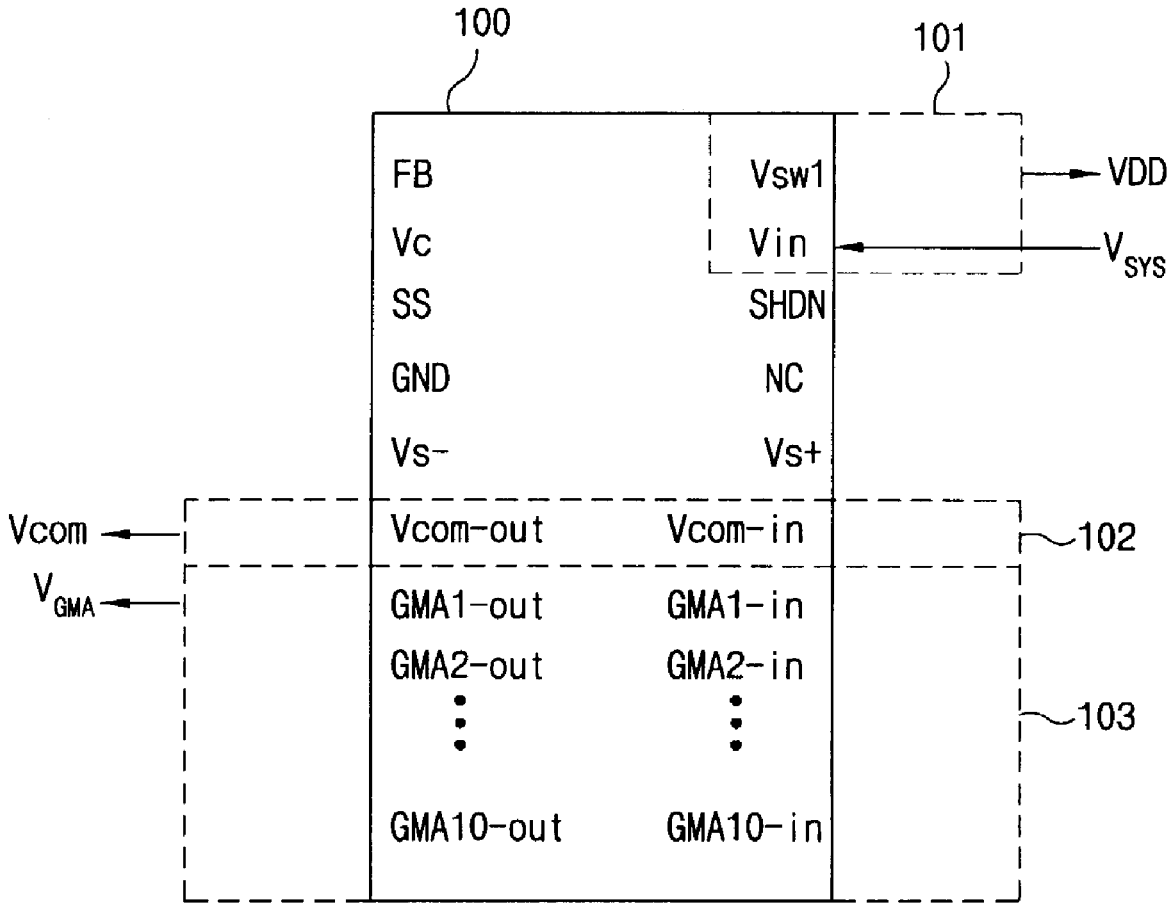
FIG. 5 is a schematic diagram of an exemplary power supply of a liquid crystal display panel according to the present invention.

FIG. 5 is an exemplary view illustrating a power supply of a liquid crystal display panel in accordance with an embodiment of the present invention. In FIG. 5, a booster 101 for generating a 7V power voltage (VDD) by boosting a 3.3V system voltage ($V_{SYS}$), a common voltage generating unit 102 for supplying the common voltage (Vcom) to the liquid crystal display panel, and partial construction elements of a gamma voltage generating unit 103 for supplying a gamma voltage ($V_{GMA}$) to the data driving unit to compensate gamma characteristics may be placed in one IC chip 100.

Functions of input/output pins of the IC chip 100 may be described in following Table 1.

TABLE 1

| I/O pins | Characteristics |
|---|---|
| Vswl | Channel 1 switch out pin |
| FB | Channel 1 feedback voltage from fixed output voltage |
| Vin | Input supply voltage |
| Vc | Channel 1 frequency compensation, etc. |
| SHDN | Channel 1 shut\down pin. High is enable/Low is disable |
| SS | Channel 1 soft-start pin |
| NC | NC or Switching Frequency selection option pin |
| GND | Boost PWM Ground |
| Vs+ | Buffer (+) supply voltage |
| Vs− | Buffer (−) supply voltage |
| Vcom-in | Common-node buffer input pin |
| Vcom-out | Common-node buffer output pin |
| GMA1-in~GMA4-in | Gamma buffer input pin |
| GMA1-out~GMA4-out | Gamma buffer output pin |

Figure 6:
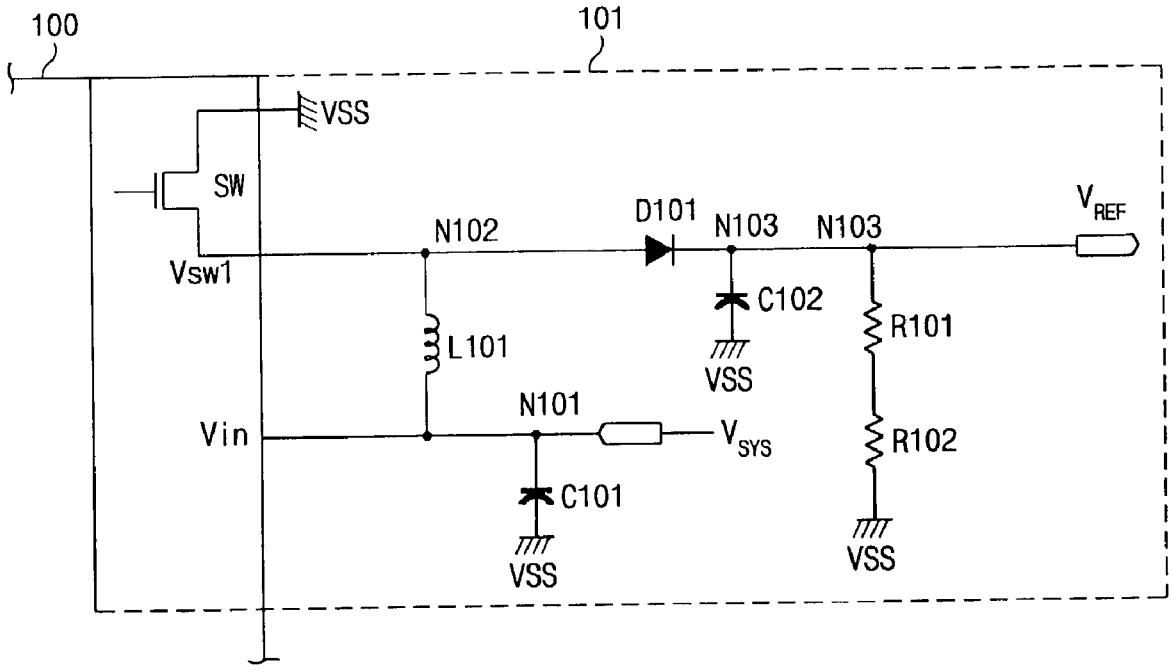
FIG. 6 is a circuit diagram of a circuit construction of a booster of FIG. 5, according to the present invention.

FIG. 6 is a circuit diagram illustrating the booster of FIG. 5. In FIG. 6, in the booster 101, the switching device (SW) of the booster 101 may be disposed in the IC chip 100, except the diode (D101), capacitors (C101, C102), an inductor (L101) and resistance (R101, R102) are arranged outside.

The booster 101 may include a 101st node (N101) in which the 3.3V system voltage ($V_{SYS}$) is applied and a 101st capacitor (C101) which may be contacted to an earth potential (VSS) therebetween; a 102nd node (N102) in which the earth potential (VSS) may be periodically applied by the switching device (SW) disposed in the IC chip 100 and a 101st inductor (L101) which may be contacted to the 101st node (N101) therebetween; and a 103rd node (N103) in which a forward 101st diode (D101) may be contacted to the 102nd node (N102) therebetween, a 102nd capacitor (C102) may be contacted to the earth potential (VSS) therebetween, a 101st and a 102nd resistance (R101, R102) which may be serially contacted to the earth potential (VSS) therebetween in order to boost the 3.3V system voltage ($V_{SYS}$) as the 7V power voltage (VDD) and outputting it.

Figure 7:
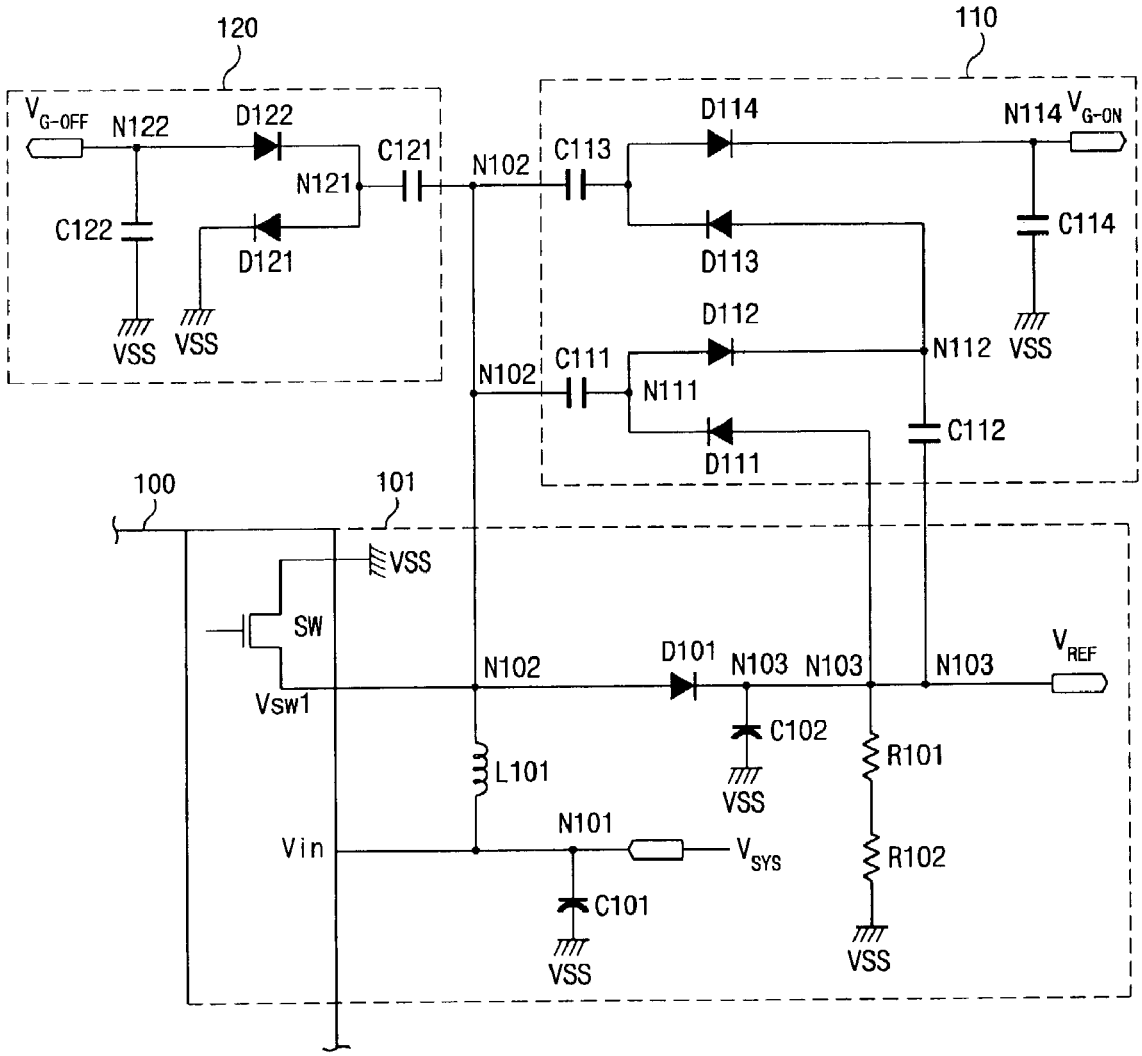
FIG. 7 is circuit diagram of an exemplary gate on/off voltage generating unit added to the circuit construction of FIG. 6, according to the present invention.

FIG. 7 is an exemplary view illustrating a gate on/off voltage generating unit added to the circuit construction of FIG. 6. In FIG. 7 the gate on/off voltage generating unit, may have a first and a second pumping units for generating the gate on/off voltage, added to the circuit construction of FIG. 6. In FIG. 7, a first pumping unit 110 may include a 111th node (N111) in which a 111th capacity (C111) may be contacted to the 102nd node (N102) therebetween and a forward 111th diode (D111) which may be contacted to the 103rd node (N103) of the booster 101 therebetween; a 112th node (N112) in which a 112th capacitor (C112) may be contacted to the 103rd node (N103) of the booster 101 therebetween and a forward 112th diode (D112) which may be contacted to the 111th node (N111) therebetween; a 113th node (N113) in which a 113th capacitor (C113) may be contacted to the 102nd node (N102) of the booster 101 therebetween and a forward 113th diode (D113) which may be contacted to the 112th node (N112) therebetween; and a 114th node (N114) in which a forward 114th diode (D114) may be contacted to the 113th node (N113) therebetween and a 114th capacitor (C114) which may be contacted to the earth potential (VSS) therebetween to output a 21V gate ON voltage ($V_{G\text{-}ON}$) by pumping and clamping the 7V power voltage (VDD).

A second pumping unit 120 may include a 121st node (N121) in which a 121st capacitor (C121) may be contacted to the 102nd node (N102) of the booster 101 therebetween and a backward 121st diode (D121) which may be contacted to the earth potential (VSS) therebetween; and a 122nd node (N122) in which a backward 122nd diode (D122) may be contacted to the 121st node (N121) therebetween and a 122nd capacitor (C122) which may be contacted to the earth potential (VSS) therebetween to output a −7V gate OFF voltage ($V_{G\text{-}OFF}$) by pumping and clamping the 7V power voltage (VDD).

Figure 8:
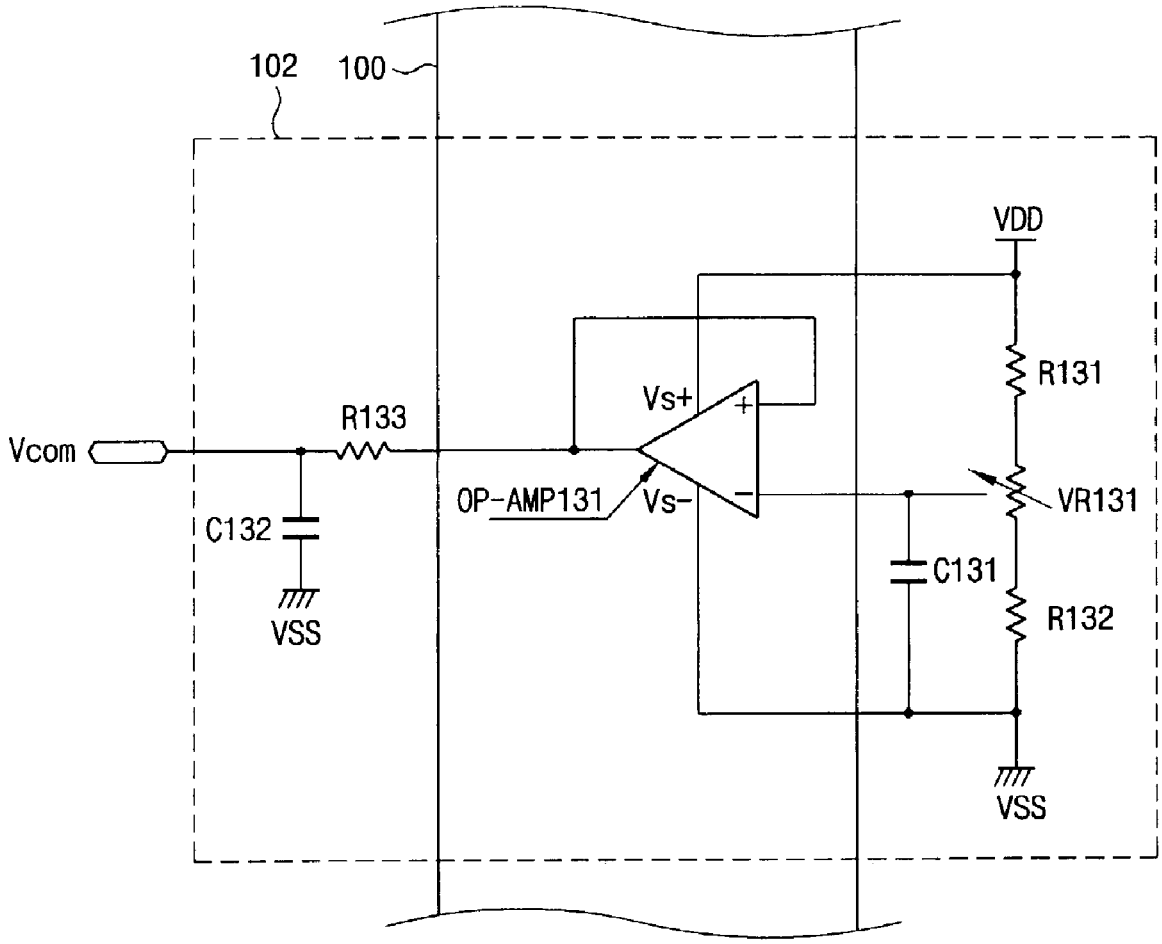
FIG. 8 is a circuit diagram of an exemplary circuit construction of a common voltage generating unit of FIG. 5, according to the present invention.

FIG. 8 is a circuit diagram illustrating a circuit construction of the common voltage generating unit 102 of FIG. 5. In FIG. 8, in the common voltage generating unit 102, a 131 operational amplifier (OP-AMP131) of the common voltage generating unit 102 may be placed in the IC chip 100, except that the resistance (R131~R133, VR131) and capacitors (C131, C132) may be arranged outside.

The common voltage generating unit 102 may include a 131st and a 132nd resistance (R131, R132) for dividing the power voltage (VDD); a variable resistance (VR131) and a 131st capacitor (C131) contacted between the 131st and 132nd resistance (R131, R132) and adjusting a level of the divided power voltage (VDD); and a 131st operational amplifier (OP-AMP131) disposed in the IC chip 100, receiving the power Voltage (VDD) divided by the 131st and 132nd resistance (R131, R132) and level-adjusted by the variable resistance (VR131) and the 131st capacitor (C131) through a non-inversion terminal (+), receiving back an output thereof through an inversion terminal (−), adjusting a level through the 133rd resistance (R133) and the 132nd capacitor (C132) and outputting it as the common voltage (Vcom). The 131st and 132nd resistance (R131, R132) generates a specific level common voltage (Vcom) by dividing the power voltage (VDD) and applying it to the non-inversion terminal (+) of the 131st operational amplifier (OP-AMP131), in order to vary the level of the common voltage (Vcom), a resistance value of the variable resistance (VR131) is varied.

Figure 9:
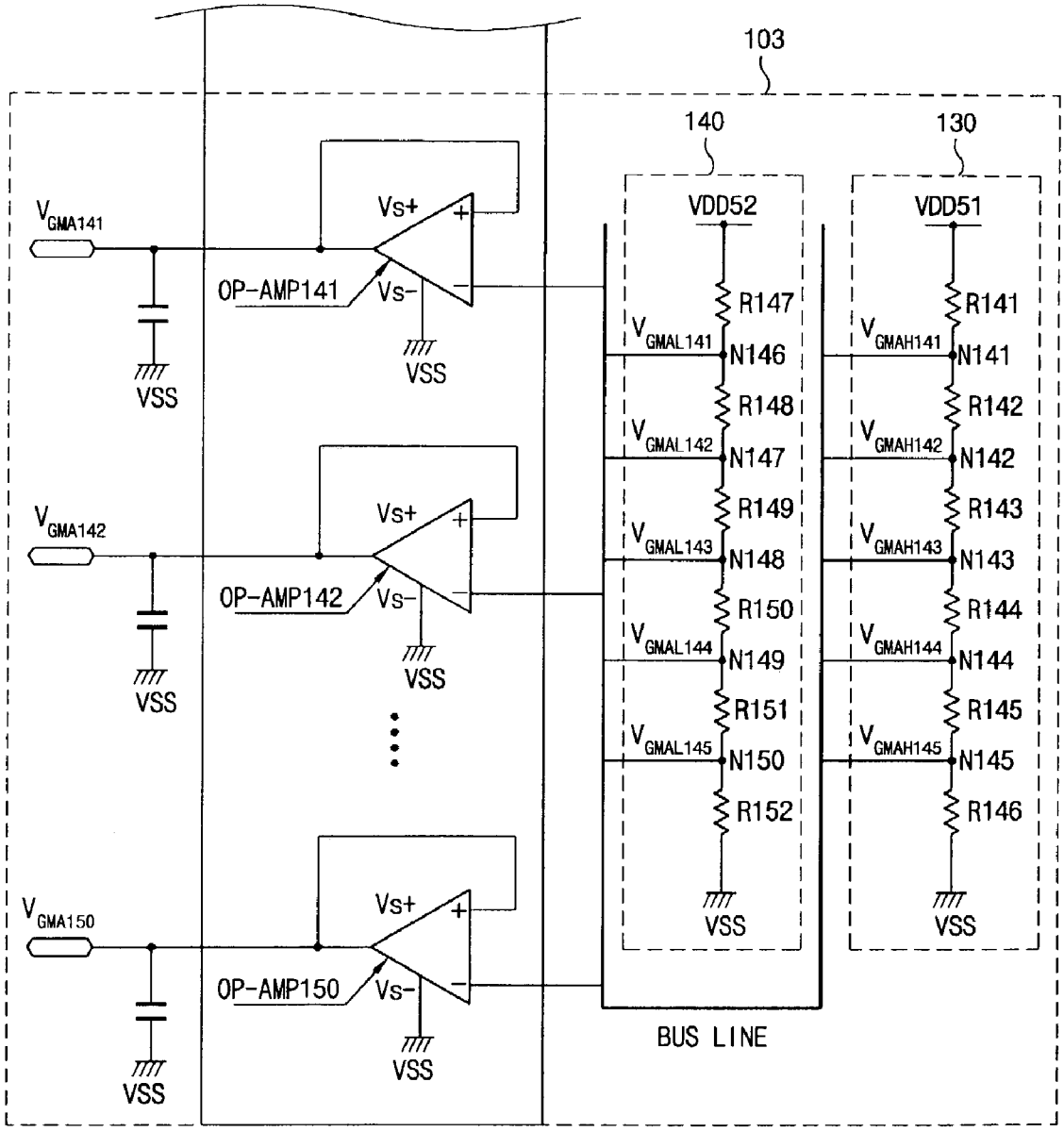
FIG. 9 is a circuit diagram of another exemplary circuit construction of a gamma voltage generating unit of FIG. 5, according to the present invention.

FIG. 9 is a circuit diagram illustrating the gamma voltage generating unit 103 of FIG. 5. In FIG. 9, in the gamma voltage generating unit 103, the 141~150 operational amplifiers (OP-AMP141~OP-AMP150) of the gamma voltage generating unit 103 are disposed in the IC chip 100, except that the resistance networks (R141~R152) are arranged outside.

The gamma voltage generating unit 103 includes a high level unit 130 for generating high level gamma voltage ($V_{GMAH141}$~$V_{GMAH145}$) for generating a gamma voltage having an inverted electricity per 1 horizontal cycle according to dot inversion driving; and a low level unit 140 for generating low level gamma voltage ($V_{GMAL141}$~$V_{GMAL145}$).

The high level unit 130 divides the power voltage (VDD141) according to a resistance ratio of the serially contacted 141st~146th resistance (R141~R146) and respectively generates the high level gamma voltage ($V_{GMAH141}$~$V_{GMAH145}$) in the 141st~145th nodes (N141~N145). The high level gamma voltage ($V_{GMAH141}$) of the 141st node (N141) has a voltage level corresponding to a black level, the high level gamma voltage ($V_{GMAH143}$) of the 143rd node (N143) has a voltage level corresponding to an intermediate level, and the high level gamma voltage ($V_{GMAH145}$) of the 145th node (N145) has a voltage level corresponding to a white level. From the high level gamma voltage ($V_{GMAH141}$) of the 141st node (N141) to the high level gamma voltage ($V_{GMAH145}$) of the 145th node (N145), the voltage level is decreased.

In addition, the low level unit 140 divides the power voltage (VDD142) according to a resistance ratio of the serially contacted 147th~152nd resistance (R147~R152) and respectively generates the low level gamma voltage ($V_{GMAL141}$~$V_{GMAL145}$) in the 146th~150th nodes (N146~N150).

The low level gamma voltage ($V_{GMAL141}$) of the 146th node (N146) has a voltage level corresponding to a black level, the low level gamma voltage ($V_{GMAL143}$) of the 148th node (N148) has a voltage level corresponding to an intermediate level, and the low level gamma voltage ($V_{GMAL145}$) of the 150th node (N150) has a voltage level corresponding to a white level. From the low level gamma voltage ($V_{GMAL141}$) of the 146th node (N146) to the low level gamma voltage ($V_{GMAL145}$) of the 150th node (N150), the voltage level is increased.

The high level gamma voltage ($V_{GMAH141}$~$V_{GMAH145}$) and the low level gamma voltage ($V_{GMAL141}$~$V_{GMAL145}$) are respectively applied to the non-inversion terminal (+) of the 141st~the 150th operational amplifiers (OP-AMP141~OP-AMP150) through a bus line, output of the 141st~the 150th operational amplifiers (OP-AMP141~OP-AMP150) is returned to the inversion terminal (−) and is outputted to the data driving unit as the gamma voltage ($V_{GMA141}$~$V_{GMA150}$) through the 141st~the 150th capacitors (C141~C150) respectively disposed in the output end of the 141st~the 150th operational amplifiers (OP-AMP141~OP-AMP150).

As described above, in the power supply of the liquid crystal display panel in accordance with the present invention, by supplying the common voltage and the gamma reference voltage required for the operation of the liquid crystal display panel in one IC circuit and adding the gate on/off voltage generating unit, construction parts can be reduced, and accordingly production costs can be lowered and design can be simplified.

It will be apparent to those skilled in the art that various modifications and variations can be made in the power supply for the liquid crystal display panel without departing from the spirit or scope of the inventions. Thus, it is intended that the present invention covers the modifications and variations of this invention provided they come within the scope of the appended claims and their equivalents.

What is claimed is:

1. A power supply for a liquid crystal display panel, comprising:

an integrated circuit (IC) chip for generating a power voltage by boosting a system voltage, the IC chip including:

a switching device;

a common voltage amplifier stage; and a gamma voltage amplifier stage;

a booster unit having a plurality of capacitors, an inductor, and resistance arranged outside the IC chip and connected to the switching device;

a common voltage adjusting stage having resistance and a plurality of capacitors arranged outside the IC chip and connected to the common voltage amplifier stage; and a resistance network stage arranged outside the IC chip and connected to the gamma voltage amplifier stage.

2. The power supply of claim 1, further comprising:

a gate on/off voltage generating unit consisting of a first pumping unit for generating a gate on voltage by pumping and clamping the power voltage of the booster unit, and a second pumping unit for generating a gate off voltage by pumping and clamping the power voltage of the booster unit.

3. The power supply of claim 1, wherein the booster unit includes:

a first node in which the system voltage is applied and a first capacitor contacted to an earth potential therebetween;

a second node in which the earth potential is periodically applied by the switching device disposed in the IC chip and a first inductor contacted to the first node therebetween; and a third node in which a forward first diode is contacted to the second node therebetween and the first and the second resistance serially contacted to the earth potential therebetween in order to boost a level of the system voltage to a power voltage level.

4. The power supply of claim 2, wherein the booster unit includes:

a first node in which the system voltage is applied and a first capacitor contacted to an earth potential therebetween;

a second node in which the earth potential is periodically applied by the switching device disposed in the IC chip and a first inductor contacted to the first node therebetween; and a third node in which a forward first diode is contacted to the second node therebetween and the first and the second resistance serially contacted to the earth potential therebetween in order to boost a level of the system voltage as a power voltage level.

5. The power supply of claim 1, wherein the common voltage adjusting stage includes a first and a second resistance for dividing the power voltage, and a variable resistance and a first capacitor contacted between the first and the second resistance to adjust a level of the divided power voltage, and wherein the common voltage amplifier stage includes a first operational amplifier disposed in the IC chip and connected to the common voltage adjusting stage and a common voltage output node, wherein the common voltage output node includes a third resistance and a second capacitor arranged outside the IC chip.

6. The power supply of claim 1, wherein the resistance network stage includes a high level unit for generating a high level gamma voltage and a low level unit for generating a low level gamma voltage, and wherein the gamma voltage amplifier stage includes a plurality of operational amplifiers disposed in the IC chip, each of the operational amplifiers connected to a corresponding one of the high level unit and the low level unit, and to a corresponding gamma voltage output node, wherein the gamma voltage output node includes a capacitor arranged outside the IC chip.

7. The power supply of claim 6, wherein the high level unit includes a first plurality of resistances connected in series to divide the power voltage according to a first resistance ratio and to respectively generate the high level gamma voltage in a plurality of high level output nodes, and the low level unit includes a second plurality of resistances connected in series to divide the power voltage according to a second resistance ratio and to respectively generate the low level gamma voltage in a plurality of low level output nodes.

8. A power supply for a liquid crystal display panel, comprising:

an integrated circuit (IC) including a common voltage amplifier stage to generate a common voltage and a gamma reference voltage, and a gamma voltage amplifier stage;

a booster unit to generate a power voltage by boosting a system voltage having at least one capacitor, at least one inductor, and at least one resistance arranged outside the integrated circuit;

a common voltage generating unit having at least one resistance and at least one capacitor connected to the at least one common voltage amplifier stage located within the integrated circuit; and a gamma voltage generating unit having a resistance network connected to the gamma voltage amplifier stage, wherein the resistance network is located outside the integrated circuit.

9. The power supply of claim 8, further comprising:

a gate on/off voltage generating unit consisting of a first pumping unit for generating a gate on voltage by pumping and clamping the power voltage of the booster unit and a second pumping unit for generating a gate off voltage by pumping and clamping the power voltage of the booster unit.

10. The power supply of claim 8, wherein the booster unit includes:

a first node in which the system voltage is applied and a first capacitor contacted to an earth potential therebetween;

a second node in which the earth potential is periodically applied by a switching device disposed in the integrated circuit and a first inductor contacted to the first node therebetween; and a third node in which a forward first diode is contacted to the second node therebetween and the first and the second resistance serially contacted to the earth potential therebetween in order to boost a level of the system voltage to a power voltage level.

11. The power supply of claim 9, wherein the booster unit further includes:

a first node in which the system voltage is applied and a first capacitor contacted to an earth potential therebetween;

a second node in which the earth potential is periodically applied by a switching device disposed in the integrated circuit and a first inductor contacted to the first node therebetween; and a third node in which a forward first diode is contacted to the second node therebetween and the first and the second resistance serially contacted to the earth potential therebetween in order to boost a level of the system voltage as a power voltage level.

12. The power supply of claim 8, wherein the common voltage generating unit includes:

a first and a second resistance for dividing the power voltage; and a variable resistance and a first capacitor contacted between the first and second resistance to adjust a level of the divided power voltage, wherein the common voltage amplifier stage includes a first operational amplifier disposed in the integrate circuit to receive the power voltage divided by the first and second resistance and level-adjusted by the variable resistance and the first capacitor and to adjust a level through a third resistance and a second capacitor to output the power voltage as a common voltage.

13. The power supply of claim 8, wherein the gamma voltage generating unit further includes:

a high level unit for generating a high level gamma voltage; and a low level unit for generating a low level gamma voltage, wherein the gamma voltage amplifier stage includes a first through a tenth operational amplifiers disposed in the integrated circuit to receive the high level gamma voltage and the low level gamma voltage through corresponding terminals and outputting a gamma voltage through first through tenth capacitors respectively arranged at an output end thereof and disposed outside the integrated circuit.

14. The power supply of claim 13, wherein the high level unit divides the power voltage according to a resistance ratio of serially contacted first through sixth resistances and respectively generates the high level gamma voltage in first through fifth nodes, and the low level unit divides the power voltage according to a resistance ratio of serially contacted seventh through twelfth resistances and respectively generates the low level gamma voltage in sixth through tenth nodes.

* * * * *